US005188471A

United States Patent [19]

Mattila

[11] Patent Number: 5,188,471

[45] Date of Patent: Feb. 23, 1993

[54] PRINTER HAVING DOCUMENT TRANSFER DEVICE WITH PLATE-SHAPED STOP MEANS

[75] Inventor: Reijo Mattila, Helsinki, Finland

[73] Assignee: ICL Personal Systems Oy, Helsinki, Finland

[21] Appl. No.: 851,949

[22] Filed: Mar. 16, 1992

[30] Foreign Application Priority Data

Mar. 25, 1991 [FI] Finland ..... 911428

[51] Int. Cl.[5] ..... B41J 13/28

[52] U.S. Cl. ..... 400/630; 400/579; 400/636; 271/245

[58] Field of Search ..... 400/630, 636, 636.1, 400/636.2, 636.3, 595, 596, 579, 599, 600, 600.1, 600.2, 600.3, 600.4, 624, 625; 271/245, 226, 229; 101/232, 242

[56] References Cited

U.S. PATENT DOCUMENTS

| | | | |
|---|---|---|---|
| 3,652,083 | 3/1972 | Bosshardt | 101/232 |
| 3,855,041 | 12/1974 | Kunisch | 101/232 |
| 4,805,892 | 2/1989 | Calhoun | 271/229 |
| 4,971,468 | 11/1990 | Yokoi | 400/634 |
| 4,986,528 | 1/1991 | Watarai et al. | 400/636 |
| 4,988,226 | 1/1991 | Ito | 400/605 |
| 5,074,545 | 12/1991 | Handa | 271/245 |
| 5,088,848 | 2/1992 | DeFalco et al. | 400/579 |

OTHER PUBLICATIONS

Kobus, "Integral Registration and Sheet Feeder Actuation", Xerox Disclosure Journal vol. 7, No. 2 1982.

*Primary Examiner*—Edgar S. Burr
*Assistant Examiner*—Lynn D. Hendrickson
*Attorney, Agent, or Firm*—Sughrue, Mion, Zinn, Macpeak & Seas

[57] ABSTRACT

A printer, comprising a print head; a paper path for a document to be printed; and a document transfer device arranged in connection with the paper path. The document transfer device is provided with parallel drive pulleys (5) gripping the underside of the document (3) and positioned on at least two sequential shafts and with spring-actuated pressure rollers (8) pressing the document from above against the drive pulleys, at least a part of the pressure rollers being possibly provided with drive and the rollers being arranged in parallel, like the drive pulleys, and sequentially above the drive pulleys to form pairs of drive pulleys and pressure rollers. The document transfer device further includes a plate-shaped stop means (9) to be guided to the paper path for straigthening the document. The stop member is positioned between the middle line through the axes of the rollers (8) positioned in the first row of the pairs of drive pulleys and pressure rollers and the rear line of said rollers.

2 Claims, 1 Drawing Sheet

PRINTER HAVING DOCUMENT TRANSFER DEVICE WITH PLATE-SHAPED STOP MEANS

Figure 3:
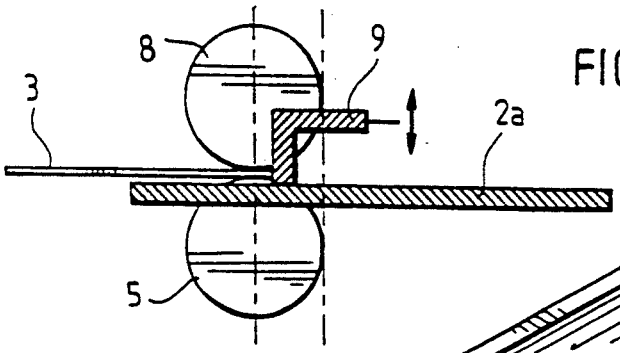

The invention relates to a printer, comprising a print head; a paper path for a document to be printed; and a document transfer device arranged in connection with the paper path and provided with parallel drive pulleys gripping the underside of the doccument and positioned on at least two sequential shafts and with spring-actuated pressure rollers pressing the document from above against the drive pulleys, at least a part of the pressure rollers being possibly provided with drive and the rollers being arranged in parallel, like the drive pulleys, and sequentially above the drive pulleys to form pairs of drive pulleys and pressure rollers; as well as a plate-shaped stop means to be guided to the paper path for straightening the document.

A document to be printed in printers of this type is straightened before it is fed in to be printed. In prior art solutions, the stop means is positioned behind the rear line of the first row of the pairs of pulleys and rollers. The stop means typically consist of pins or clutches, by means of which the paper path can be closed or opened. In some solutions the stop means is plate-shaped. Before being fed in, the document is usually manually placed against a stop means or several stop means and when the document is found to be aligned against the stop means, the drive pulleys and the pressure rollers are pressed together and the stop means is moved out of the paper path. After this the document can be driven in to be printed.

A problem with the prior art solutions is that the document straightening operation cannot be automated without difficulties. If the stop means consist of pins or clutches, the edge of the document is subjected to dot-like stresses while being fed against the stop means. Notches are then easily formed at the front edge of the document, especially if the documents are thin. Further due to this, the edge of the document is not necessarily in precise alignment with the stop means any more. Moreover, the mutual distance of the pins defines the breadth of the document. The distance between the pins is usually too broad for narrow documents. In addition, the distance between the first row of the pairs of drive pulleys and pressure rollers and the front edge of a stop means/several stop means is too big, in which case thin documents bend when they hit the stop means, if an attempt is made to use said row of pulleys and rollers for straightening the document.

The object of the present invention is to avoid the problems mentioned above in such a way that the document straightening operation can be easily automated. This object is achieved by means of a printer according to the invention, which is characterized in that the stop means is arranged between the middle line through the axes of the pulleys and rollers positioned in the first row of the pairs of pulleys and rollers and the rear line of said pulleys and rollers.

Consequently, a positioning of the stop means as per the invention makes it possible to automate the document straightening operation, which accelerates the operation of the printer decisively. For the automation are used the first drive pulleys and pressure rollers of the printer, by means of which the document is fed against the stop means. When the document hits the stop means, the driving pulleys begin to slide. During sliding the obliquely fed document is straightened to be parallel with the stop means. The support of the pressure rollers is planned in such a way that they can be loaded by a slight force during sliding and by a force about ten times bigger during the actual feeding. This is necessary because of the fact that no sliding is permissible when the stop means is moved out of the paper path after the straightening operation and when the document is driven out of the paper path.

Figure 1:
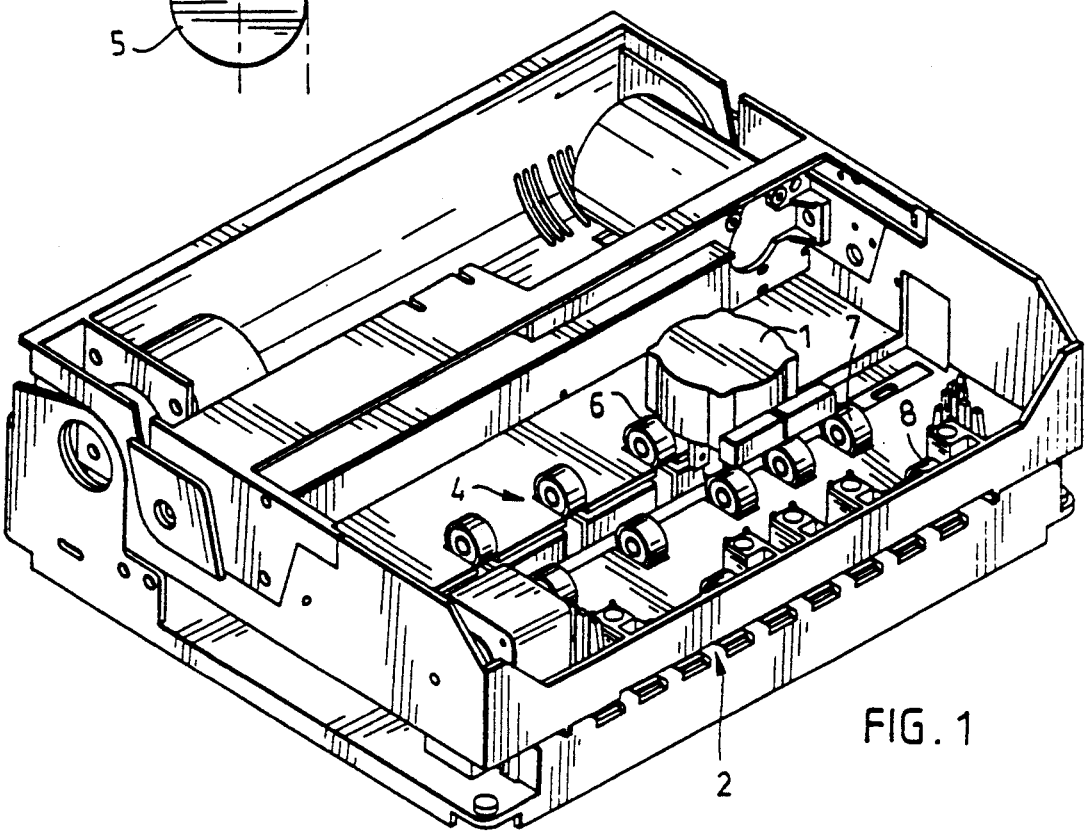
Figure 2:
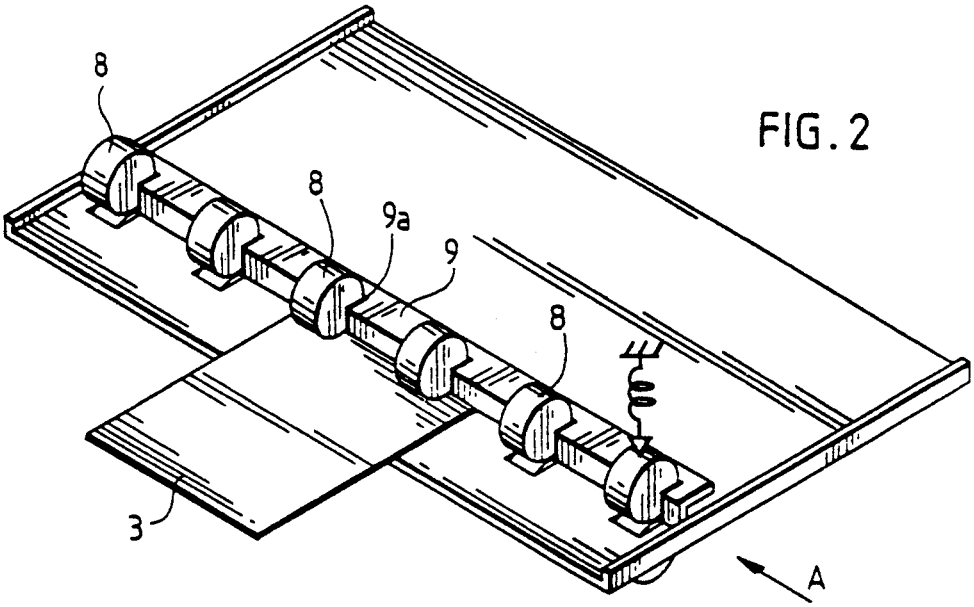

Below the invention will be described in greater detail by means of an embodiment referring to the accompanying in which FIG. 1 shows a simplified general view of a printer, FIG. 2 a simplified view of the first row of pressure rollers and of a stop means arranged in connection therewith, and FIG. 3 the structure of FIG. 2 in the direction of an arrow A.

A printer according to FIG. 1 comprises a print head 1, a paper path 2 for a document 3 (FIG. 2) to be printed and a document straightening and transfer device 4 arranged in connection with the paper path 2. FIG. 1 shows the printer simplified and all parts and details thereof are not shown.

The straightening and transfer device 4 comprises parallel drive pulleys 5 gripping the underside of the document 3 and positioned on three sequential shafts and spring-actuated pressure rollers 6, 7 and 8 pressing the document 3 from above against the drive pulleys 5, which pressure rollers, except for the pressure rollers 8, can also be provided with drive and which are arranged in parallel, like the drive pulleys 5, and sequentially above the drive pulleys 5 to form pairs of drive pulleys and pressure rollers (FIG. 3). In FIG. 1 the drive pulleys 5 are hidden below the pressure rollers 6, 7 and 8.

The straightening and transfer device 4 additionally comprises a plate-shaped stop means 9 positioned on the paper path 2, for straightening the doccument 3. The stop means 9 is positioned between the middle line through the axes of the pulleys 5 and rollers 8 positioned in the first row of the pairs of drive pulleys and pressure rollers and the rear line of these pulleys and rollers above a lower support surface 2*a* of the paper path 2, whereby the stop means extends between the pressure rollers 8 of the first row of pressure rollers. The stop means 9 is a profile with for instance an L-shaped cross-section with recesses 9*a* for the pressure rollers 8.

The first row of pressure rollers and the stop means 9 form the actual document 3 straightening mechanism. For straightening the document 3, the first pressure rollers 8 are loaded by a slight force, and then, the document being supported against the stop means 9, the drive pulleys 5 are able to slide so that the document can be straightened against the stop means. After the document 3 has been straightened, the stop means 9 is lifted from the paper path 2 and the load of the pressure rollers 8 is increased about tenfold, and then the document can move forward on the paper path for printing.

I claim:

1. A printer for printing on a document, comprising:

a print head;

a paper path for the document to be printed, said paper path including a lower support surface; and a document transfer device arranged in connection with said paper path, said document transfer device comprising: a plurality of drive pulleys arranged in parallel for gripping an underside of the document and positioned in at least two sequential rows; and a plurality of spring-actuated pressure rollers arranged in parallel along their rotational axes and disposed transversely with respect to said paper path in first and second rows sequentially above said drive pulleys so as to form pairs of drive pulleys and pressure rollers, with said pressure rollers pressing the document from above against said drive pulleys;

said document transfer device further comprising: a plate-shaped stop means operative to move up and down with respect to said paper path for straightening the document, wherein said stop means is arranged between a line passing through the rotational axes of said pressure rollers positioned in the first row of the pairs of said drive pulleys and said pressure rollers and a line touching a rear portion of said pressure rollers, said stop means being positioned above said lower support surface of said paper path, wherein said stop means extends between said pressure rollers of the first row of pressure rollers and forms a continuous bar across said paper path.

2. The printer according to claim 1, wherein said stop means has an L-shaped transverse cross-section and includes recesses for receiving said pressure rollers of the first row.

* * * * *